US005325618A

United States Patent [19]

Turner

[11] Patent Number: 5,325,618

[45] Date of Patent: Jul. 5, 1994

[54] SAFETY DEVICE FOR A RIFLE

[76] Inventor: Harold W. Turner, P.O. Box 652, Corbin, Ky. 40702

[21] Appl. No.: 5,090

[22] Filed: Jan. 15, 1993

[51] Int. Cl.[5] ..... F41C 33/00; F41H 17/00

[52] U.S. Cl. ..... 42/85; 224/149; 224/913

[58] Field of Search ..... 42/85, 94; 224/149, 224/150, 913, 236, 240

[56] References Cited

U.S. PATENT DOCUMENTS

| | | | |
|---|---|---|---|
| 919,301 | 4/1909 | Anderson | 224/149 |
| 2,423,531 | 7/1947 | Theis | 224/189 |
| 2,536,252 | 1/1951 | Bates | 224/149 |
| 2,647,667 | 8/1953 | Brown et al. | 224/149 |
| 3,081,923 | 3/1963 | Bagby | 224/149 |
| 3,348,746 | 10/1967 | Stumpf | 224/270 |
| 3,430,828 | 3/1969 | Gregson | 224/149 |
| 3,441,185 | 4/1969 | Moomaw | 224/150 |
| 3,528,108 | 9/1970 | Smith | 2/94 |
| 3,606,109 | 9/1971 | Brokus | 224/149 |
| 3,655,106 | 4/1972 | Wojanski | 224/150 |
| 3,700,147 | 10/1972 | Vaughn | 224/913 |
| 3,819,094 | 6/1974 | Hyde | 42/94 |
| 3,869,074 | 3/1975 | Roach | 42/85 |
| 4,140,253 | 2/1979 | Vickers et al. | 42/94 |
| 4,760,944 | 8/1988 | Hughes | 224/150 |
| 4,895,285 | 1/1990 | Dunn | 224/149 |
| 4,982,522 | 1/1991 | Norton | 42/85 |
| 5,134,797 | 8/1992 | Turner | 42/85 |

FOREIGN PATENT DOCUMENTS

| | | | |
|---|---|---|---|
| 248623 | 7/1912 | Fed. Rep. of Germany | 224/913 |
| 64171 | 3/1925 | Sweden | 224/913 |

*Primary Examiner*—David H. Brown

*Attorney, Agent, or Firm*—Dickinson, Wright, Moon, Van Dusen & Freeman

[57] ABSTRACT

A safety device for a rifle, or other elongate firearm, includes a first part for removably attaching the stock to the chest of a user and a cord for supporting the butt portion below the user's chest. The firearm can, thus, be supported in a safe, substantially vertical orientation to allow the user's hands to be free. The stock portion is easily released to allow the rifle to be operated with the cord remaining attached and providing additional safety.

19 Claims, 1 Drawing Sheet

SAFETY DEVICE FOR A RIFLE

TECHNICAL FIELD

This invention relates to the art of safety devices for firearms. In particular, the device attaches a firearm to the body of a user to reduce the possibility of self-infliction of a wound.

BACKGROUND

My prior U.S. Pat. No. 5,134,797, discloses a safety device for use with a firearm, such as a rifle, to restrict the movement of the firearm. That device permits a range of motions such that normal use of the firearm is permitted, but movement of the firearm into an orientation where it can be aimed at the user's head or torso is prevented. The device shown in that patent, however, requires the user to use at least one of his hands to carry the rifle.

There are many times when a user would like to carry a rifle safely without the use of his hands and yet to have the rifle available for immediate use. Devices that permit a user to carry a rifle without the use of the hands are known, but these devices are not safe. For example, U.S. Pat. No. 3,441,185 (Moomaw) shows a gun sling that can hold a rifle on the front of a user when the sling is in a particular position. That position is not fixed, however, and the rifle can be easily moved to an unsafe position when the user bumps the rifle, as during a fall. U.S. Pat. No. 2,423,531 (Theis) shows a hook attached to the jacket of a user near the shoulder for supporting one end of a rifle. The other end of the rifle must be supported by a hand of the user, and the rifle would certainly be dislodged from the hook were the user to fall. U.S. Pat. No. 3,348,746 (Stumpf) shows a support for a rifle, but the rifle is held in a position that endangers those around the user.

SUMMARY OF THE INVENTION

In accordance with the invention, apparatus is provided for removably securing the stock portion of a rifle to the chest of a user near the shoulder and for supporting the butt of the rifle below the stock such that the rifle is held in a substantially vertical orientation without requiring the use of the user's hands. (It should be noted that when the term "rifle" is used in this application, it is intended to refer to any elongated firearm.)

In the preferred embodiment, the portion of the device of the invention that supports the butt of the rifle is essentially that shown in U.S. Pat. No. 5,134,797 whereby the benefits of that device are achieved in the apparatus described herein.

The device of the invention may be in the form of a harness for removable attachment to the user, or the elements may be integral with a garment to be worn by the user or in any other convenient form.

DETAILED DESCRIPTION OF THE PREFERRED EMBODIMENT

Figure 1:
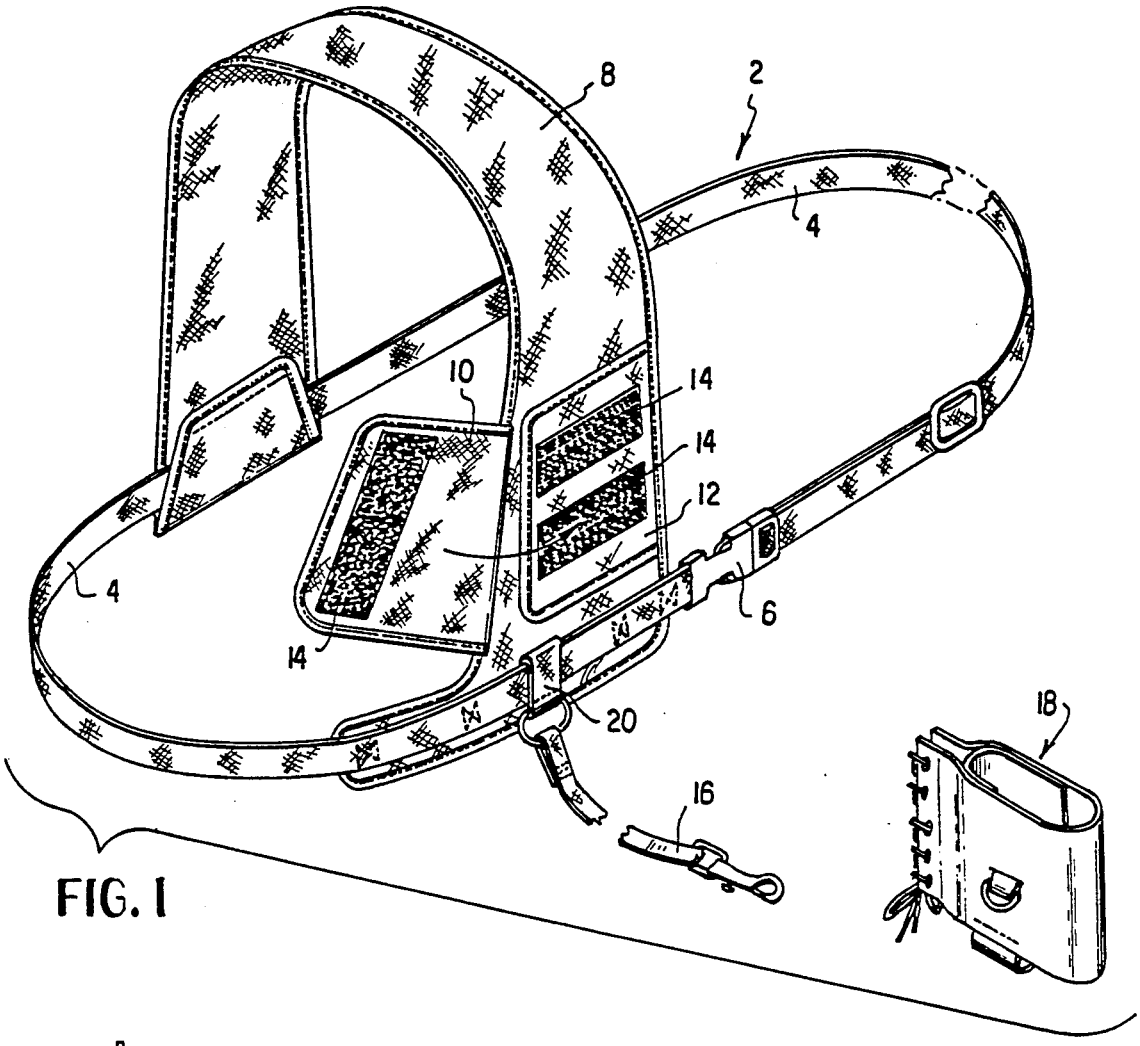
FIG. 1 is a perspective view of a preferred embodiment of a device in accordance with the invention.

With reference to FIG. 1 of the drawings, an apparatus in accordance with the invention comprises a harness 2 for being attached to a user. The harness includes a strap 4 which encircles the chest of the user and has a buckle 6 for permitting the harness to be easily put on or taken off by the user. A cross piece 8 extends from the front of the device to the back and is positioned such that it passes over the shoulder of the user when in the operative position illustrated in FIGS. 2 through 4. The harness shown in FIG. 1 is for a right-handed user, and a left-handed user would use a harness that mirrors that shown in FIG. 1.

Figure 2:
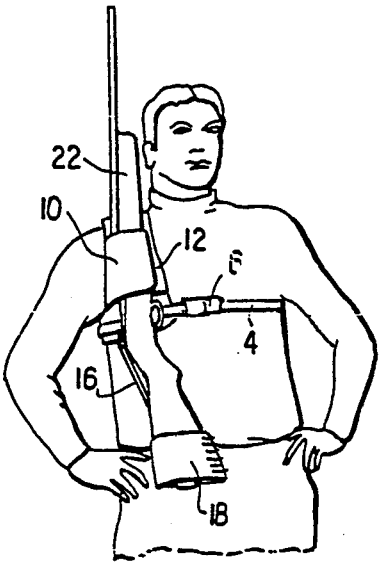
FIGS. 2 through 4 are schematic views of a user wearing the device of FIG. 1 and illustrating its use.

Attached to the front of the cross piece 8 are two flaps 10 and 12 for engaging the stock portion of a firearm, as illustrated in FIG. 2, to support it in a substantially vertical orientation. The function of these flaps in the preferred embodiment is twofold. The primary function of the flaps is to hold the stock in the vertical orientation securely and yet provide for easy release of the rifle. In the preferred embodiment, the flaps include strips 14 (e.g., of Velcro) for holding the two flaps together when the rifle stock has been inserted and for holding it to the cross piece. These strips also hold the two flaps together when the rifle has been removed, however, to provide the added function of a shoulder pad to absorb the recoil of the rifle when it is being fired. Of course, structures other than the illustrated flaps may be used to secure the stock portion of the rifle to the user's chest.

Cord 16 is attached to the strap 4 just below the flaps 10 and 12 to provide the safety features described in my U.S. Pat. No. 5,134,797 as well as to support the lower part of the rifle when the rifle is held in the vertical orientation. A sleeve 18, which fits over the end of the rifle, may be provided to engage the other end of the cord 16 and to attach the butt portion of the rifle to the harness 2. Cord 16 is preferably attached to strap 4 by a sliding loop 20 to allow the position of attachment of the cord to the chest of the user to be adjusted to accommodate easily both the firing and support positions of the rifle.

Figure 3:
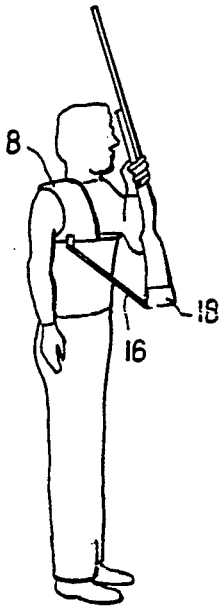
Figure 4:
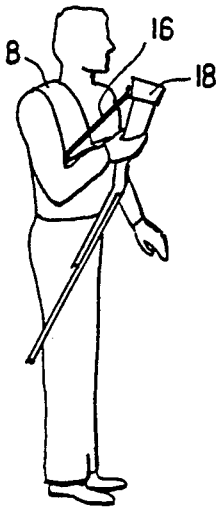

The preferred operation of the invention is illustrated in FIGS. 2 through 4. In each of these figures, the harness 2 is being worn by a user. FIG. 2 shows a rifle 22 in a vertical orientation wherein the stock portion is secured to the chest of the user by engagement between the flaps 10 and 12 and the cross piece 8, and the butt portion is supported by the cord 16. In this position, the user's hands are free, and the rifle is safe because the muzzle is aimed upward and away from the user's face. This allows the user to perform tasks with his hands and yet be able to release the stock portion from engagement with the chest and move the rifle to an operative position quickly.

FIGS. 3 and 4 illustrate the operation of the safety cord 16 after the rifle has been released from engagement with the user's chest as further described in my prior patent.

It will be appreciated that a novel device for facilitating safe use of a firearm has been described. Modifications within the scope of the appended claims will be apparent to those of skill in the art.

I claim:

1. Apparatus for supporting an elongate firearm in a substantially upright orientation on the chest of a user, comprising:

holding means for securely holding a first portion of said firearm near a shoulder of said user, securing means for securing said holding means to the breast of the user; and support means for supporting a second portion of said firearm directly below said shoulder, wherein said support means and said holding means are oriented so as to hold the firearm in a substantially vertical orientation.

2. The apparatus of claim 1, wherein said support means restricts the movement of the second portion of the firearm within a range for allowing unhindered normal operation of the firearm and preventing the inadvertent aiming of the muzzle of the firearm at the head or torso of the user.

3. The apparatus of claim 1 wherein said holding means comprises first and second flaps for folding over at least part of the first portion of the firearm and being secured to each other.

4. The apparatus of claim 1, wherein said securing means is a shoulder harness, comprising:

a substantially horizontal loop extending across the chest and around the back of the user; and a substantially vertical strap extending over a shoulder of the user.

5. The apparatus of claim 4, wherein one portion of said vertical strap is connected to said horizontal loop in the vicinity of the breast of the user, and a second portion of said vertical strap is connected to said horizontal loop in the vicinity of the back of the user.

6. Apparatus according to claim 1 wherein said holding means is situated to encompass at least a part of the barrel of the firearm.

7. Apparatus according to claim 6 wherein said support means is situated to support at least a portion of the butt of the firearm.

8. Apparatus according to claim 7 wherein said support means supports said second portion substantially directly below said holding means.

9. Apparatus according to claim 8 wherein said support means restricts the movement of said second portion within a range for allowing unhindered normal operation of the firearm while preventing the inadvertent aiming of the muzzle of the firearm at the head or torso of the user.

10. Apparatus for supporting an elongate firearm, comprising:

holding means for securely holding the stock of the firearm near a shoulder of the user, said holding means comprising first and second flaps for folding over at least part of the first portion of the firearm near a shoulder of the user and being secured to each other; and support means for supporting a second portion of said firearm below said shoulder.

11. Apparatus of claim 10, wherein said first flap and said second flap are secured to each other by means of a hook and loop type fastener.

12. Apparatus of claim 10, wherein said support means is located substantially directly below said holding means.

13. Apparatus of claim 10, wherein said support means comprises a strap depending from said securing means.

14. Apparatus according to claim 10, wherein said holding means is situated to encompass at least a part of the barrel of the firearm.

15. Apparatus according to claim 14, wherein said support means is situated to support at least a portion of the butt of the firearm.

16. Apparatus of claim 15 wherein said holding means and said support means maintain the firearm in a substantially upright orientation on the chest of a user.

17. Apparatus for supporting an elongate firearm in a substantially upright orientation on the chest of a user, comprising:

holding means for securely holding at least a portion of the barrel of the firearm near a shoulder of the user, said holding means comprising first and second flaps for folding over at least a portion of the barrel of the firearm near a shoulder of the user and being secured to each other; and support means for supporting at least a portion of the butt of the firearm below the shoulder of the user and substantially directly below said holding means and for restricting the movement of the butt of the firearm with respect to the body of a user within a range for allowing unhindered normal operation of the firearm and preventing the inadvertent aiming of the muzzle of the firearm at the head or torso of the user.

18. Apparatus according to claim 17, further comprising:

harness means for securing said holding means and said support means to the body of said user.

19. Apparatus according to claim 18, wherein said holding means further comprises means for absorbing the kick of the firearm.

* * * * *